United States Patent [19]

Jacobson

[11] Patent Number: 4,529,202

[45] Date of Patent: Jul. 16, 1985

[54] GOLF CLUB HEAD

[76] Inventor: William W. Jacobson, 11209 White St., North Huntingdon, Pa. 15642

[21] Appl. No.: 517,234

[22] Filed: Jul. 25, 1983

[51] Int. Cl.[3] ..... A63B 53/04

[52] U.S. Cl. ..... 273/168; 273/175; 273/169; 273/174

[58] Field of Search ..... 273/167 A, 167 B, 167 E, 273/174, 175, 192, 167 J, 167 K, 77 R; D21/217, 218, 219

[56] References Cited

U.S. PATENT DOCUMENTS

| | | | |
|---|---|---|---|
| 2,472,312 | 6/1949 | Parrish | 273/175 |
| 3,220,730 | 11/1965 | Fine | 273/77 R |
| 3,319,964 | 5/1967 | Steinberg | 273/192 X |
| 3,806,129 | 4/1974 | Burrows | 273/167 A X |

*Primary Examiner*—George J. Marlo

*Attorney, Agent, or Firm*—Thomas R. Trempus

[57] ABSTRACT

The invention is a golf club head for use as a putter, and includes a blade member with a relatively wide and generally planar upper surface, opposed first and second ends and at least one and preferably two striking surfaces, relatively short in height, for contacting a golf ball with a predetermined diameter. A hosel is operably associated with the blade member for receiving therein a golf club shaft with a grip at one end thereof. Disc-like segments or members are provided to elevate and support the blade member such that the striking surfaces are elevated to a height equal to approximately one-half of the diameter of the golf ball. The disc-like members are also provided with indicia which indicates a predetermined amount of weight so that the club can be reduced in weight a predetermined amount by removing a portion of the disc-like member as identified by the indicia.

6 Claims, 4 Drawing Figures

GOLF CLUB HEAD

BACKGROUND OF THE INVENTION

The present invention relates to the improvement of a golf club, namely the putter, which is used on the green, or putting surface surrounding the hole, for the purpose of rolling the ball to the hole. The invention is particularly useful in the fringe or longer grass areas surrounding the putting surface of the green. However, it is also useful on the putting surface, away from the fringe or longer grass areas.

There are many instances when a golf ball that is hit onto the green will roll across the putting surface and will come to rest against, or in, the fringe or the longer grass area surrounding the green. With the ball in such a location, the use of the putter to achieve the desired control of direction and speed in rolling the ball to the hole becomes questionable due to the design of presently available putters. The typical design of such putters tends to position the blade or striking surface at ground level and, therefore, if the ball which has come to rest against or in the longer grass, is addressed in the same manner as if it were positioned entirely on the putting surface, the blade or striking surface is then positioned down in the densest or heaviest part of the grass. In trying to hit the ball with the blade in such a position, the grass will deflect the blade and the ball, as well as restrict or slow the movement of the blade towards the ball. Therefore, in addition to hitting the ball harder to try to avoid or reduce the effects of the grass on the ball and the putter blade, the blade must be raised and held at a higher point of contact on the ball which, not being a normal putting stance, is an unsteady position from which to initiate the putting stroke. Unless the golfer has considerable experience in the execution of such a stroke, the results are undesirable.

It has been known to construct a golf club head so as to cause a struck ball to hug the ground closely, due to the effects of over-spin. Such a club is taught in U.S. Pat. No. 2,472,312 in which a striking surface is positioned above the vertical center of the golf ball. Such a configuration ensures that the ball is "topped" and over-spin results.

It is an object of this invention to provide a putter which can be used in the longer grass areas surrounding the green without altering the basic putting stroke as would be used on the putting surface of the green. The basic putting stroke in this case being to move the putterhead away from and back into the ball, on as shallow an arc as possible, with the striking surface of the blade making square contact with ball.

It is an additional object of this invention to provide a single golf club head so configured that it can be utilized as both a right-handed and left-handed club head. It is yet another object of this invention to provide a golf club head which lends itself to weight modification and balance adjustment by the user.

SUMMARY OF THE INVENTION

The invention is directed to a golf club, particularly a golf club head for use as a putter. The golf club head includes a blade member with a generally planar upper surface, opposed first and second ends and at least one and preferably two striking surfaces for contacting a golf ball with a predetermined diameter. A hosel means is operably associated with the blade member for receiving therein a golf club shaft with a gripping means at one end thereof. Means are provided to elevate and support the blade member such that the striking surface is elevated to a height equal to approximately one half of the diameter of the golf ball. Thus, the blade member itself does not contact the ground. In one embodiment the support means are disc-like members approximately equal to the diameter of the golf ball. In a second embodiment, the support means are disc segments which are approximately equal to 180° of the aforementioned disc-like member. The support means have a bearing surface which contacts the ground as the golf ball is addressed by the club head. The bearing surfaces are of a width selected to minimize drag with the ground while inhibiting any cutting action of the support means into the ground. Thus the golf club head strikes the ball with a controlled horizontal component of force and preferably no vertical component.

BRIEF DESCRIPTION OF THE DRAWINGS

The above as well as other features and advantages of this invention will be more readily appreciated through a consideration of the detailed description in conjunction with the accompanying drawings in which.

DETAILED DESCRIPTION OF THE INVENTION

Figure 1:
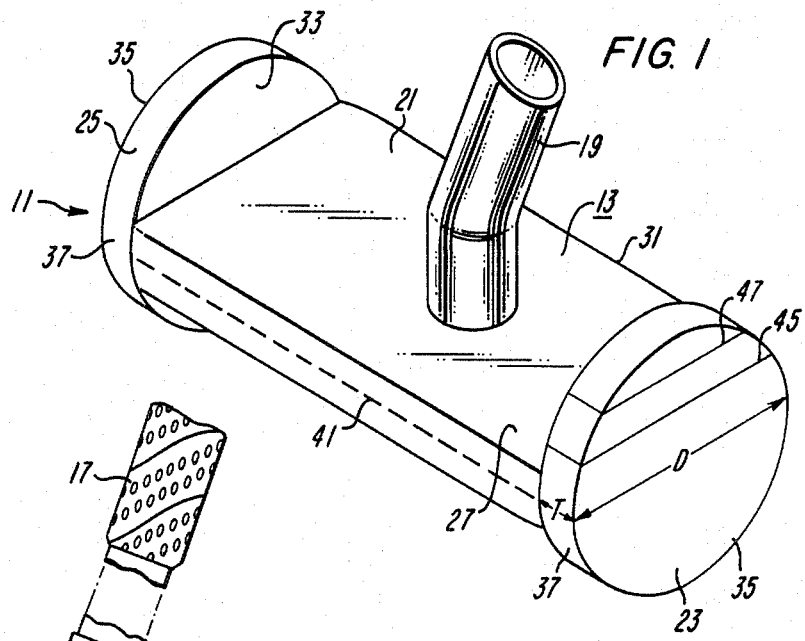
FIG. 1 is a perspective view of a golf club head according to a first embodiment of the invention.

Two embodiments of the invention are described herein. Considering FIGS. 1 and 3, a golf club according to a first embodiment is generally indicated by the reference character 11. The golf club 11 includes a golf club head 13 and a club shaft 15 with a grip means 17 at one end thereof opposite the club head 13. The shaft 15 is connected to the club head 13 by means of a hosel 19, a tube like member which can either be straight as shown or bent to accommodate a desired configuration between the club head 13 and the shaft 15.

Figure 3:
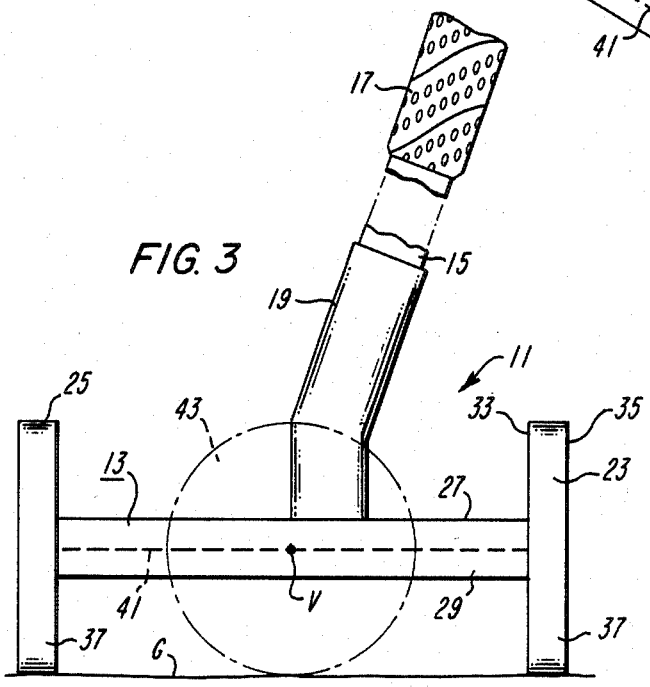
FIG. 3 is a front elevational view of a golf club with portions of the shaft cut away according to this invention in contact with a golf ball.
Figure 4:
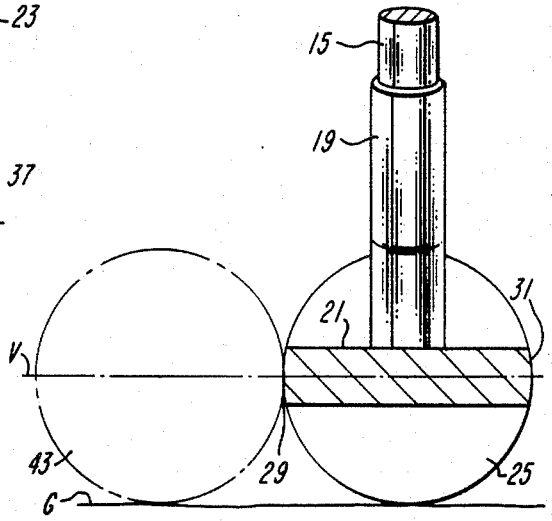
FIG. 4 is a side elevational, sectional view of a golf club head according to this invention in contact with a golf ball.

The club head 13 of the first embodiment has a blade member 21 and a pair of disc-like members 23 and 25 vertically disposed at opposed ends of the blade member 21 and substantially normal thereto. As can be seen in FIGS. 1, 3 and 4, the blade member 21 includes an upper planar surface 27, a right handed striking surface 29 and a left handed striking surface 31 both striking surfaces being generally normal to the planar surface 27. The hosel 19 is securely positioned in the upper planar surface 27 at a location selected to provide a desired balance to the golf club 11. Each disc-like member 23, 25 includes an inner face 33, an outer face 35 and a bearing surface 37 about the circumference thereof. The disc-like member has a diameter "D" which is apprximately equal to the diameter of a golf ball and a thickness "T" selected such that the bearing surface 37 is of a minimal width. It has been found that a thickness "T", equal to approximately ¼ inch, minimizes drag between the game surface 39 and the club head 13 while substantially eliminating any tendency of the club head 13 to cut into the surface 39. This preferred thickness is particularly well suited for use on putting surfaces, fringe areas and higher grass.

The club head 13 can be manufactured from a series of individual elements or it can, for example, be formed as a single piece by metal casting techniques. It should be appreciated that the golf club head design of this invention is readily usable as either a right or a left handed club. The blade member 21 is positioned relative to the disc-like members 23, 25 such that a longitudinally disposed center line of the striking surface 29, 31 as shown by the dash-dot line 41, makes contact with the golf ball 43 shown in phantom at its mid point as will be described below.

An additional feature of the present invention is incorporated into the embodiment illustrated in FIG. 1. The disc-like members 23, 25 provide a predetermined weight to the golf club head. As described below, the disc like members can be modified in an alternative embodiment in order to adjust the club head weight. To provide the user with an increased control over the club head weight, each of the disc-like members can be provided with indicia which indicates a predetermined amount of weight. The indicia, indicated at 45 and 47, can, for example, consist of one or more scores on the surface of the disc-like members. By using the score at 45 as a guide, for example, the club can be reduced in weight a predetermined amount by cutting or grinding away that portion of the disc-like member above the score.

Figure 2:
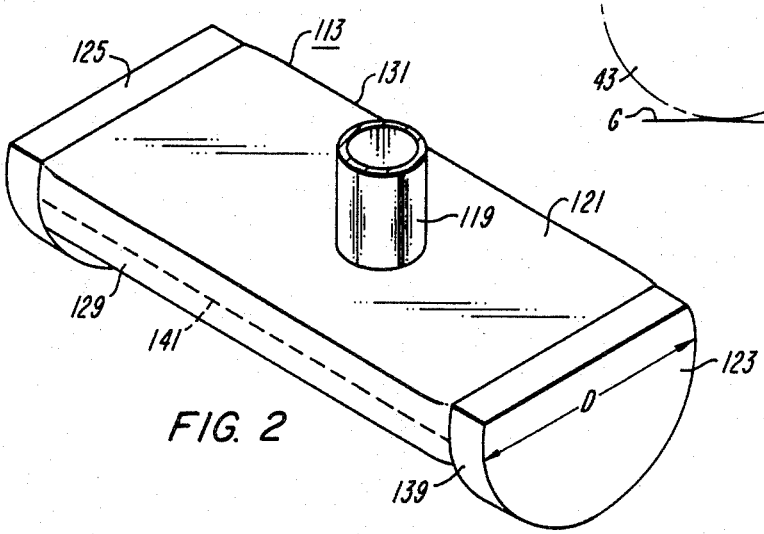
FIG. 2 is a perspective view of a golf club head according to an alternative embodiment of the invention.

Turning to FIG. 2, an alternative embodiment of the golf club head of the invention is generally indicated by the reference character 113. The club head 113 has a hosel 119, a blade member 121 and a pair of disc segment members 123 and 125, vertically disposed at opposed ends of the blade member 121 and substantially perpendicular thereto. This second embodiment is substantially similar to the first embodiment shown in FIG. 2 with the exception of the use of segmented discs which tend to reduce the weight of the golf club head 113. As can be seen, the blade member does not contact the ground, but rather is elevated relative thereto.

Each disc segment 123, 125 has a diameter "D" substantially equal to the diameter of a golf ball and a bearing surface 139 with a thickness equal to about $\frac{1}{4}$ inch. More importantly, in the alternative embodiment, the disc segment 123, 125 must be of sufficient dimension to align the center-line 141 of the club head striking surface 129 (131) with the mid-point of a golf ball. Accordingly, the disc-segments can be disposed to depend from the underside of the blade member 121 or as illustrated the blade member 121 can be disposed between two opposed disc segments.

Considering both FIGS. 3 and 4, the relationship of the blade member to the disc-like members and the disc segments can be fully appreciated. While only the embodiment of the invention as described in conjunction with FIG. 1 is shown, it is understood that both embodiments and the possible modifications thereto conform to the concepts discussed herein. The blade member 21 is affixed in a horizontal plane between the two vertically disposed disc-like members 23, 25. The blade member is permanently elevated to a position whereby the striking surface 29 (31) of the golf club head 13 corresponds with the mid-point or center line of the golf ball when the golf club head is in contact with the ball on a common surface. Moreover the present golf club head configuration tends to place the mass centers of the blade member and the golf ball, along a common vector "V" when contact therebetween is made during play. The disc-like members minimize the surface area of the club head which is in contact with the ground G when putting and help to insure that the club head striking surface is properly aligned with the golf ball. Thus the golf club head strikes the ball with a controlled horizontal component of force along the common vector "V" while preferably transmitting no vertical component of force to the ball.

What is claimed is:

1. A golf club head for use in combination with a golf ball of a predetermined diameter on a game surface comprising:

a blade member having a generally planar upper surface with opposed first and second ends and opposed first and second striking surfaces for contacting said golf ball, said striking surfaces disposed in a generally normal relationship to said upper surface, wherein said golf club head can function as both a right and left handed head, the vertical dimension of each of said striking surfaces being substantially less than the horizontal dimension of said planar upper surface between said striking surfaces, first and second disc-like members, each having an inner face, an outer face and a bearing surface about the circumference thereof; said disc-like members having a diameter which is approximately equal to the predetermined diameter of the golf ball and having a thickness selected such that drag between the game surface and said golf club head is minimized; said disc like members being vertically disposed at said opposed first and second ends of said blade member wherein a portion of said first disc-like member inner face is integral with said first end and a portion of said second disc-like member inner face is integral with said second end, elevationally supporting said blade member in a fixed horizontal plane therebetween such that said striking surfaces are elevated to a height equal to approximately one half of said predetermined diameter, whereby said striking surfaces correspond with a mid-point of the golf ball when said golf club head bearing surfaces and the golf ball are on the game surface and wherein said golf head strikes the golf ball with a controlled horizontal component of force while transmitting no vertical component of force to the golf ball; and hosel means securely positioned in said upper surface of said blade member for receiving therein a club shaft.

2. The golf club head according to claim 1 wherein the first and second disc-like members each have a bearing surface which contacts the ground when contacting the golf ball with the striking surface, said bearing surface being of a width selected to minimize drag between the ground and the golf club head while not cutting into the ground as the golf ball is being addressed.

3. The golf club head according to claim 1 including a shaft having a grip means at one end thereof operably associated with the hosel means.

4. A golf club head for use in combination with a golf ball of a predetermined diameter on a game surface comprising:

a blade member having a generally planar upper surface with opposed first and second ends and opposed first and second striking surfaces for contacting said golf ball, said striking surfaces disposed in a generally normal relationship to said upper surface, wherein said golf club head can function as both a right and left handed head, the vertical dimension of each of said striking surfaces being substantially less than the horizontal dimension of said planar upper surface between said striking surfaces, first and second disc-like members, each having an inner face, an outer face and a bearing surface about the circumference thereof; said disc-like members having a diameter which is approximately equal to the predetermined diameter of the golf ball and having a thickness selected such that drag between the game surface and said golf club head is minimized; said disc like members being vertically disposed at said opposed first and second ends of said blade member wherein a portion of said first disc-like member inner face is integral with said first end and a portion of said second disc-like member inner face is integral with said second end, elevationally supporting said blade member in a fixed horizontal plane therebetween such that said striking surfaces are elevated to a height equal to approximately one half of said predetermined diameter, whereby said striking surfaces correspond with a mid-point of the golf ball when said golf club head bearing surfaces and the golf ball are on the game surface and wherein said golf head strikes the golf ball with a controlled horizontal component of force while transmitting no vertical component of force to the golf ball wherein the portion of each said disc-like member extending above said blade member includes indicia thereon indicating a predetermined weight increment of said disc-like member, whereby said golf club head can be reduced in weight by a predetermined amount by removing a section of said disc-like member so indicated, and hosel means securely positioned in said upper surface of said blade member for receiving therein a club shaft.

5. The golf club head according to claim 4 wherein the first and second disc-like members each have a bearing surface which contacts the ground when contacting the golf ball with the striking surface, said bearing surface being of a width selected to minimize drag between the ground and the golf club head while not cutting into the ground as the golf ball is being addressed.

6. The golf club head according to claim 4 including a shaft having a grip means at one end thereof operably associated with the hosel means.

* * * * *